United States Patent [19]

Hutchins

[11] Patent Number: 5,022,190

[45] Date of Patent: Jun. 11, 1991

[54] WET SANDING TOOL

[75] Inventor: Alma A. Hutchins, Pasadena, Calif.

[73] Assignee: Hutchins Manufacturing Company, Pasadena, Calif.

[21] Appl. No.: 577,046

[22] Filed: Aug. 30, 1990

Related U.S. Application Data

[63] Continuation of Ser. No. 294,197, Jan. 6, 1989, abandoned.

[51] Int. Cl.[5] ..... B24B 23/02

[52] U.S. Cl. ..... 51/170 MT; 51/267

[58] Field of Search ..... 51/170 T, 170 TL, 170 MT, 51/267, 266, 273, 358, 391, 392, 393; 251/8, 9, 10

[56] References Cited

U.S. PATENT DOCUMENTS

| | | | |
|---|---|---|---|
| 2,832,560 | 4/1958 | Grigsby | 251/9 |
| 3,110,993 | 11/1963 | Grage | 51/267 |
| 3,544,060 | 12/1970 | Stoltz | 251/9 |
| 4,102,084 | 7/1978 | Bloomquist | 51/170 MT |
| 4,129,966 | 12/1978 | Smart et al. | 51/267 X |
| 4,490,948 | 1/1985 | Hanstein et al. | 51/267 |
| 4,660,329 | 4/1987 | Hutchins | 51/170 MT |
| 4,671,019 | 6/1987 | Hutchins . | |
| 4,671,020 | 6/1987 | Hutchins . | |

FOREIGN PATENT DOCUMENTS

| | | | |
|---|---|---|---|
| 59-765 | 4/1983 | Japan | 51/267 |

*Primary Examiner*—Maurina Rachuba
*Attorney, Agent, or Firm*—William P. Green

[57] ABSTRACT

A portable powered abrading tool including a body adapted to be held and be manipulated by a user, a sanding pad or other unit mounted to the body for movement relative thereto and adapted to carry a sheet of abrasive material or other work abrading element, and a motor for driving the pad relative to the body, with the pad or other movable unit containing a passage or passages to be connected to a source of water and which deliver the water through the interior of the unit and discharge it from the unit onto a work surface. The movable unit has a surface bearing against the sheet of abrasive material and containing openings through which the water is discharged for delivery through registering openings in the sheet of abrasive material and onto the work.

9 Claims, 4 Drawing Sheets

FIG. 1
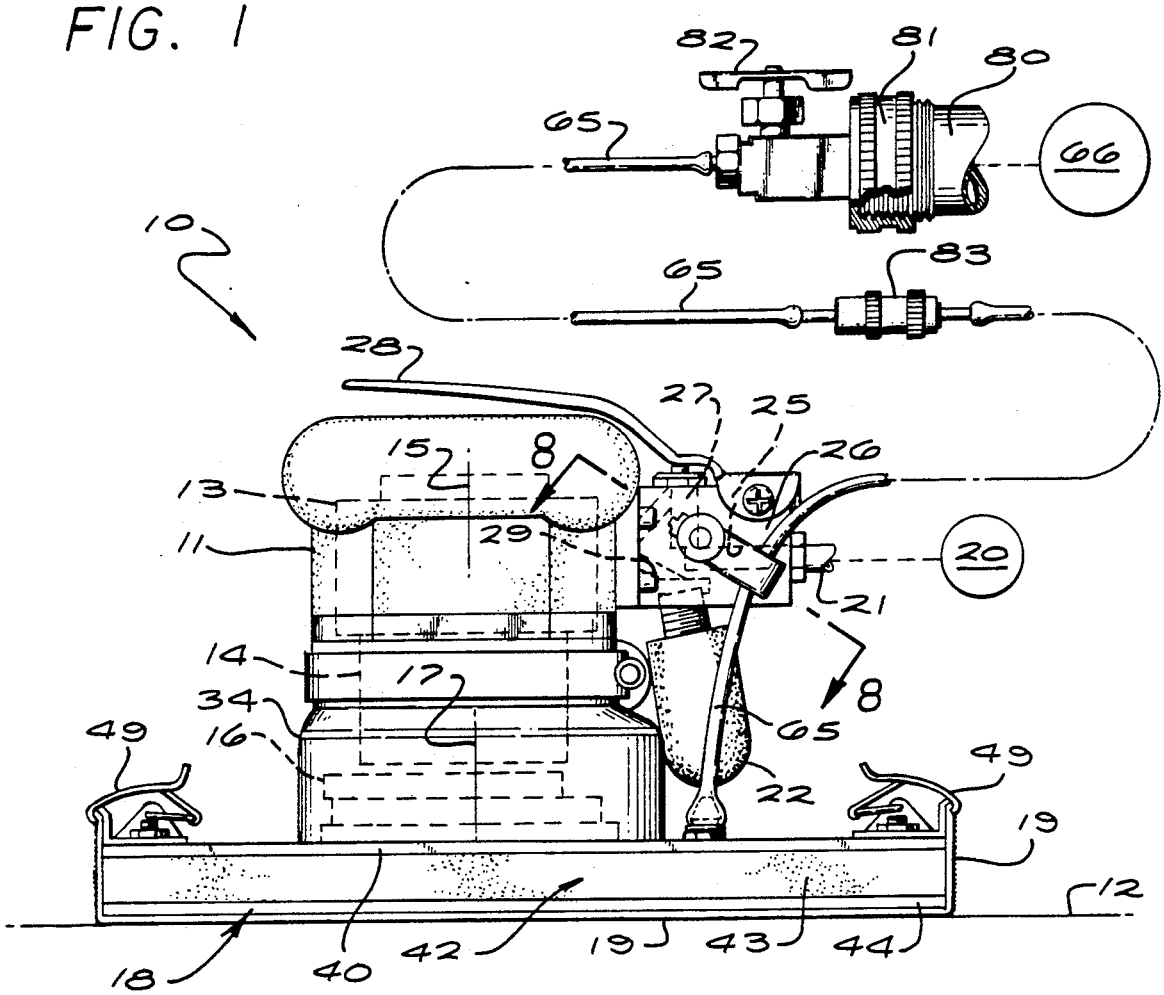
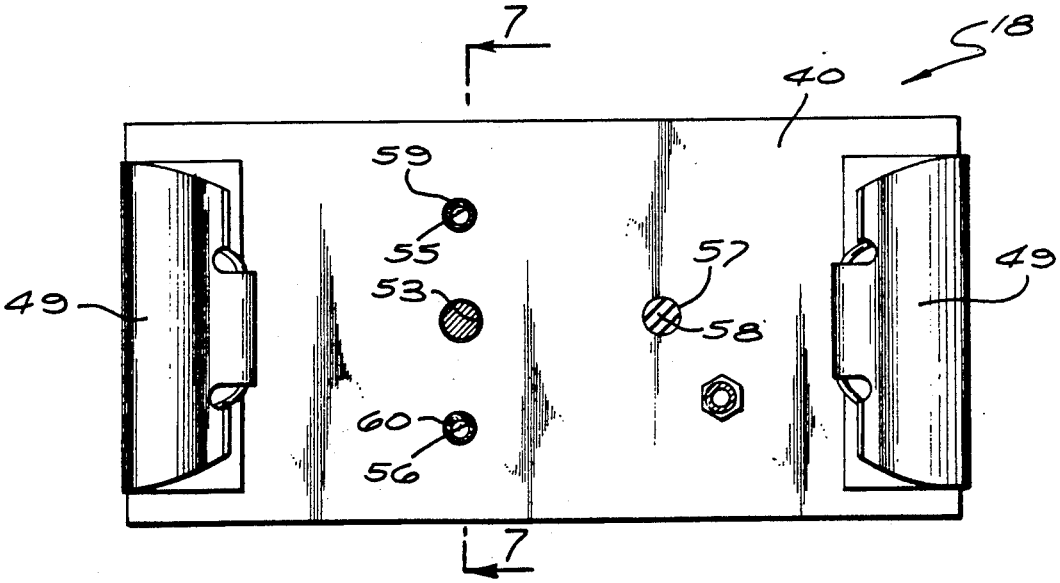
FIG. 3

FIG. 7
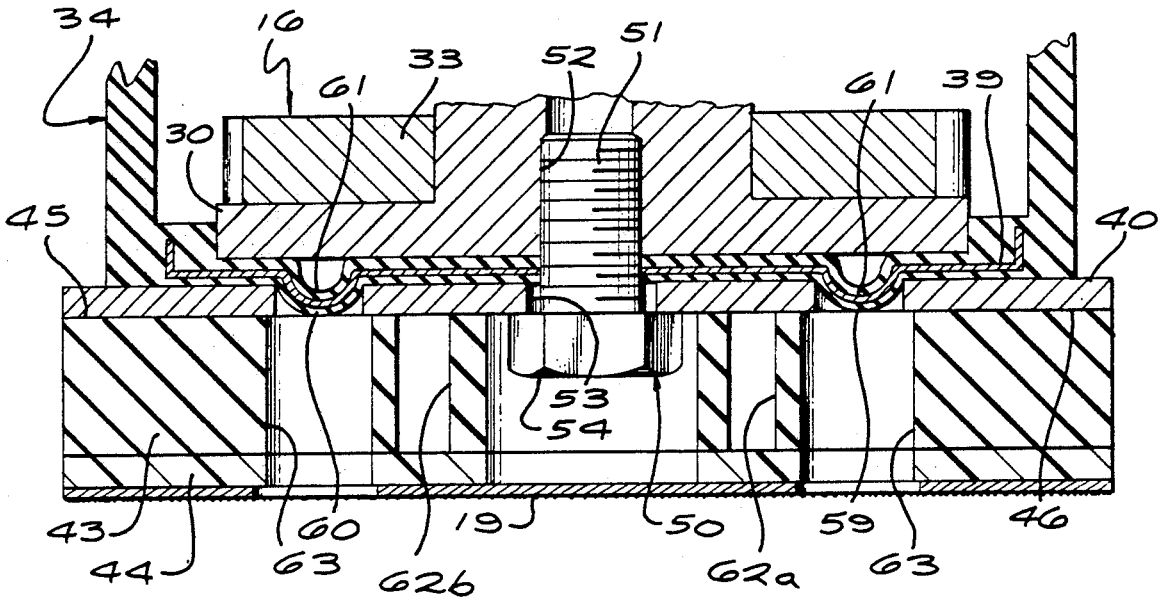
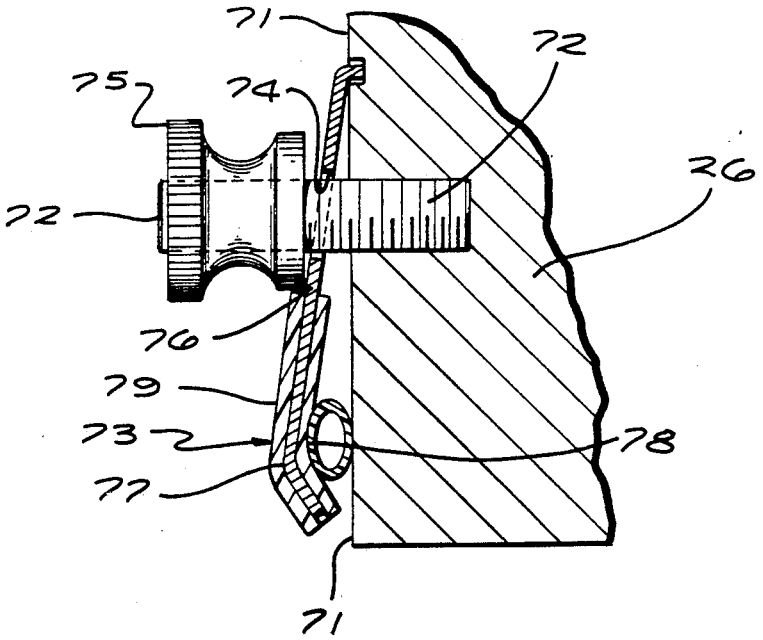
FIG. 8

WET SANDING TOOL

This is a continuation of copending application Ser. No. 07/294,197 filed on 1/6/89 now abandoned.

This invention relates to improved portable power driven sanders for abrading a work surface.

Background of the Invention

In some sanding operations, the effectiveness of the abrading action can be enhanced by maintaining the work surface being abraded in a wet condition as it is sanded. Water may be delivered to the work surface by a hose, sprayer, or the like, and acts to cool and to lubricate the work part and the sandpaper and carry away abraded particles.

Summary of the Invention

A major purpose of the present invention is to provide an improved arrangement for delivering water to a work surface during a sanding or other abrading operation. The present invention enables the water to be discharged onto the work at exactly the location at which the sanding sheet or other abrading element is in contact with and acting against the work surface. In this way, the enhancement of the abrading action is maximized, and the sanding sheet or other abrasive material is kept clean continually to avoid damage to the abrading element and prevent degradation of the sanding effect by the presence of particles abraded from the work surface.

To achieve these results, the water is directed through a passage or passages formed within the interior of the sanding head or other movable work abrading unit, and is discharged from those passages onto the work surface at the location of the sandpaper or other abrading element. The pad preferably includes a cushion formed of deformable material, desirably attached to and carried by a more rigid backing plate. The passage or passages may be formed in the deformable cushion, and may deliver water through openings formed in an undersurface of the pad against which a sheet of sandpaper can be carried. Preferably, the sandpaper contains openings opposite the discharge ends of the passages, so that the water emits downwardly from the passages through openings in the sandpaper sheet to a location directly between the sandpaper and the work surface.

The water may be delivered to the passages in the pad through a conduit structure including a valve desirably attached to and carried by the handle body of the tool and which is manually adjustable to regulate the rate of water delivery to the work. The conduit structure may take the form of a flexible hose which extends past the handle body of the tool and which has a portion adjacent the body constrictable to varying conditions to adjust the rate of delivery of the water.

Brief Description of the Drawings

The above and other features and objects of the invention will be better understood from the following detailed description of the typical embodiment illustrated in the accompanying drawings, in which:

FIG. 1 is a side elevational view of a portable powered sander embodying the invention;

FIG. 3 is a horizontal section taken on line 3—3 of FIG. 2;

FIG. 7 is an enlarged vertical section taken on line 7—7 of FIG. 3; and

FIG. 8 is an enlarged fragmentary section taken on line 8—8 of FIG. 1.

Figure 2:
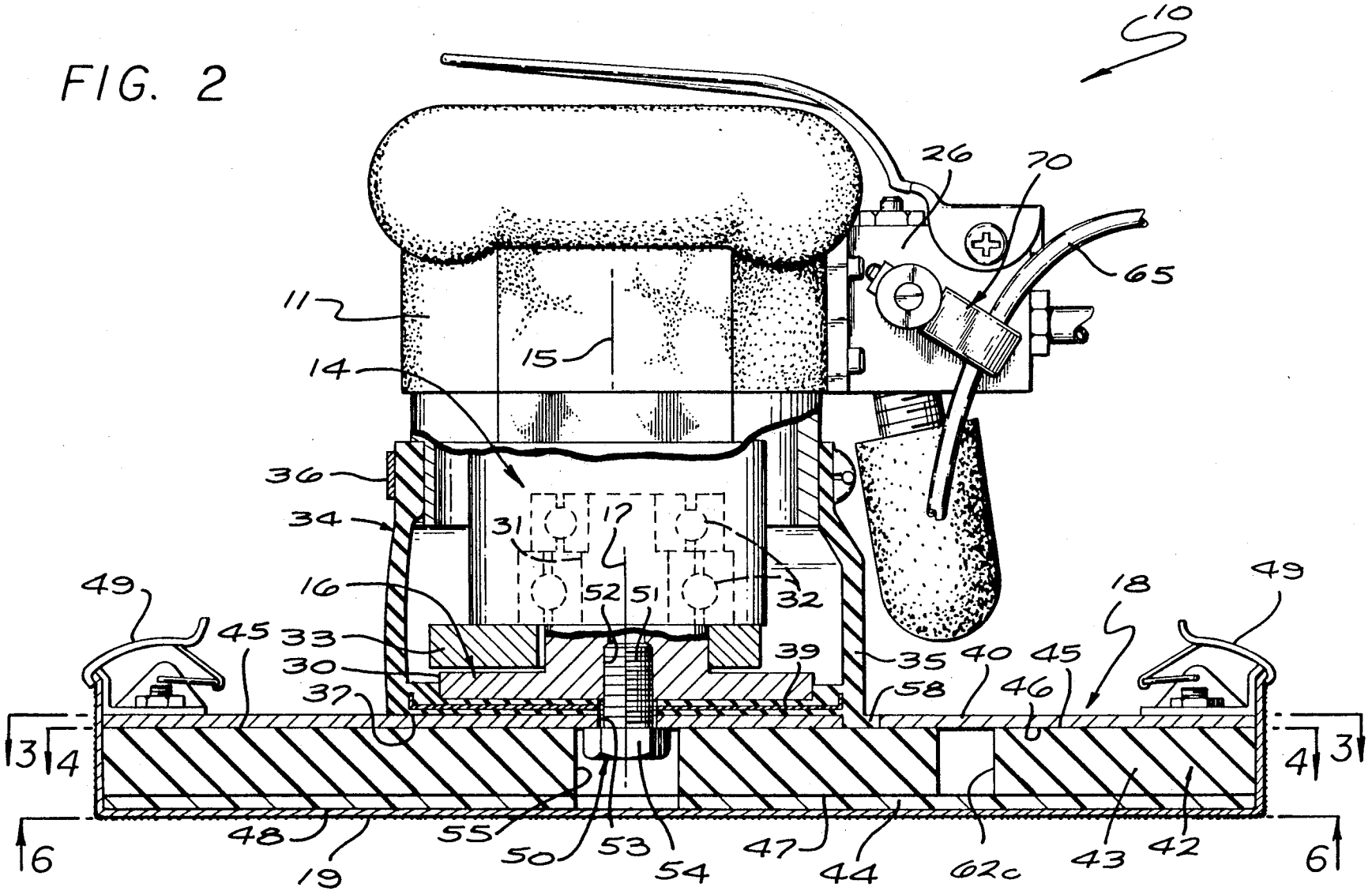
FIG. 2 an enlarged view of the sander, partially in elevation as in FIG. 1, and with the lower portion illustrated in section.

The tool 10 illustrated in the drawings is a power driven oribtal sander having a body structure 11 shaped externally as a handle to be grasped by a user for holding the tool and moving it along a typically horizontal work surface 12 to sand or polish that surface. An air driven motor 13 is contained within the body structure 11 and drives a carrier part 14 (FIG. 2) rotatively about a vertical axis 15, with a part 16 being connected to carrier 14 for rotation relative thereto about a second vertical axis 17 offset slightly from and parallel to axis 15, in a relation driving an abrading pad or shoe 18 and a carried sheet of sandpaper 19 orbitally about axis 15 to sand the surface 12. Air is supplied to motor 13 from a source 20 of compressed air through a line 21 connecting into the rear of body structure 11. Exhaust air is discharged from the motor through a filter 22. The air delivered to motor 13 flows from inlet line 21 through a passage 25 in a block 26 attached to the handle body 11 of the device, with a valve 27 in the block being actuated manually by a lever 28 to control the delivery of air to the motor in a manner starting and stopping the operation of the sander. Air exhausted from the motor flows through an inclined second passage 29 in block 26, and to the filter 22.

The orbitally driven part 16 may have a lower horizontally extending flange portion 30 which may be circular about the axis 17 of that part. Projecting upwardly from flange 30, part 16 has a shaft portion 31 centered about and extending upwardly along axis 17, and which is journalled within carrier part 14 by bearings typically represented at 32 to enable the previously mentioned rotation of part 16 relative to part 14 about axis 17. A counterweight 33 may be connected to part 14 to balance the eccentricity of part 16 and the other connected parts with respect to the principal axis 15 of motor 13.

A shroud or boot 34 forms an enclosure about the orbital drive mechanism of the device, and may have an essentially tubular generally vertically extending sidewall 35 formed of rubber or other resiliently deformable elastomeric material and secured at its upper end by an annular clamp 36 to a lower portion of the handle body 11 of the tool. At the lower end of side wall 35 of shroud 34, the shroud may have a horizontally extending bottom wall 37 formed of elastomeric material containing a rigid preferably metal reinforcing plate 39 for stiffening the bottom wall of the device and facilitating its connection to the orbitally moving drive element 16.

The sanding pad or shoe 18 includes a rigid preferably metal backing plate 40, which is typically of rectangular horizontal section as seen in FIG. 3. Beneath the backing plate 40, pad 18 includes a deformable cushion 42 through which force is applied to the sandpaper sheet 19 in a manner cushioning contact of the sandpaper with the work surface 12. The cushion 42 is preferably formed of two layers of resiliently deformable material, including a relatively thick upper layer 43 and a thinner bottom layer 44, both of which are of the same rectangular horizontal section as top backing plate 40. Layer 43 is desirably made of a resiliently deformable closed pore resinous plastic foam, such as polyurethane foam or the like. The upper horizontal surface 45 of foam layer 43 may be bonded to the horizontal undersurface 46 of the more rigid backing plate 40. The bottom layer 44 of cushion 42 is typically formed of a sheet of fabric backed vinyl material, tightly and permanently bonded to the horizontal undersurface 47 of layer 43, and has a horizontal undersurface 48 which engages and applies downward force to the sandpaper sheet 19. The layer or sheet 44 is resiliently deformable with upper layer 43 and the sandpaper sheet, to maintain the sandpaper continuously in contact with the work surface during a sanding operation. Sandpaper 19 may be secured adhesively to the underside of bottom sheet 44 of the sanding pad, or may be releasably secured to the pad by spring clips 49 of any known type attached to opposite ends of backing plate 40.

Pad 18 is rigidly but detachably secured to the orbitally movable drive element 16 of the tool by a screw or bolt 50, having a threaded shank 51 which is connectable into a correspondingly threaded bore 52 in part 16 centered about axis 17. Shank 51 extends through aligned openings 53 in plate 40 and the bottom wall of boot 34, with an enlarged head 54 of screw 50 being tightenable upwardly against plate 40 to apply upward clamping force thereto and secure it to element 16. Screw 50 may be insertible upwardly through typically circular openings 55 formed in layers 43 and 44 of cushion 42 and defining a recess within which head 54 is received at a level above that of the sandpaper sheet when the sanding pad is attached to the tool.

In addition to opening 53 in backing plate 40, that plate may also contain three openings 55, 56 and 57 (FIG. 3) into which projections formed on the bottom wall 37 of boot 34 project to maintain pad 18 against rotary movement relative to the boot. The projections on the boot may include a rubber projection 58 (FIG. 2) extending downwardly into opening 57, and two projections 59 and 60 (FIG. 7) receivable within the two openings 55 and 56 respectively. The projections 59 and 60 may be formed by providing downwardly projecting dimples 61 in the metal of reinforcing plate 39 and in the rubber coating it as seen in FIG. 7, with the rubber being a sufficiently tight fit in openings 55 and 56 to form a seal preventing the flow of water upwardly through those openings from the interior of the sanding pad.

Figure 6:
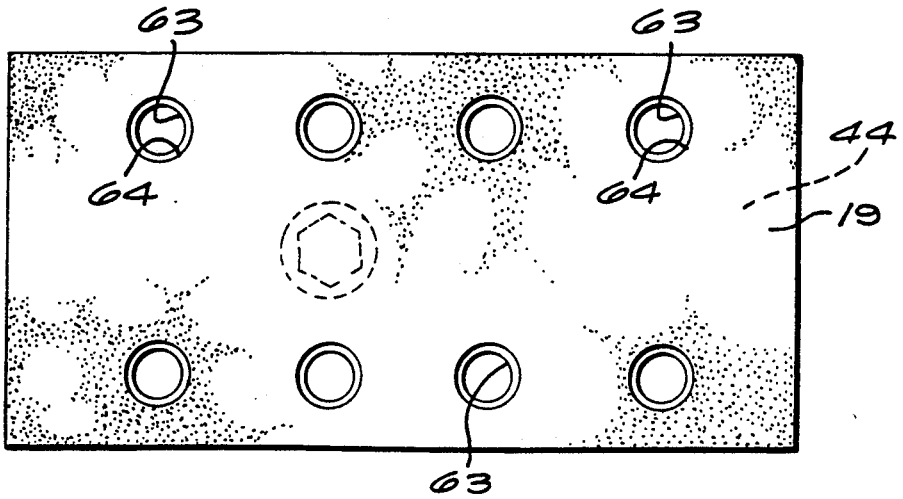
FIG. 6 is a bottom plan view taken on line 6—6 of FIG. 2 and showing the hole pattern at the underside of the sanding pad.

Water is delivered to the work surface 12 through a number of communicating passages 62 formed in the foam layer 43 of cushion 42, which passages discharge the water downwardly through a number of openings 63 formed in bottom layer 44 which may be arranged in the pattern illustrated in FIG. 6. Sandpaper sheet 19 contains openings 64 at the locations of and registering with openings 63 of bottom layer 44 of the sanding pad, to allow the water to flow downwardly through the openings 63 and 64 to the underside of the sandpaper sheet 19, for flow laterally between the sandpaper sheet and the work surface in a manner flushing abraded particles from the work surface and lubricating the sanding action. The openings 63 and 64 may be arranged in two parallel rows as seen in FIG. 6, and may be circular as shown.

Figure 4:
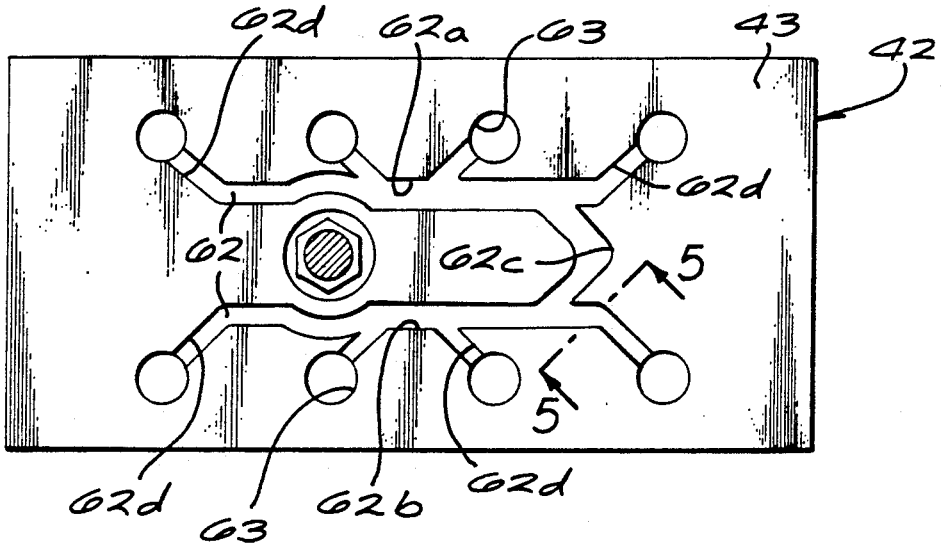
FIG. 4 is a horizontal section taken on line 4—4 of FIG. 2.
Figure 5:
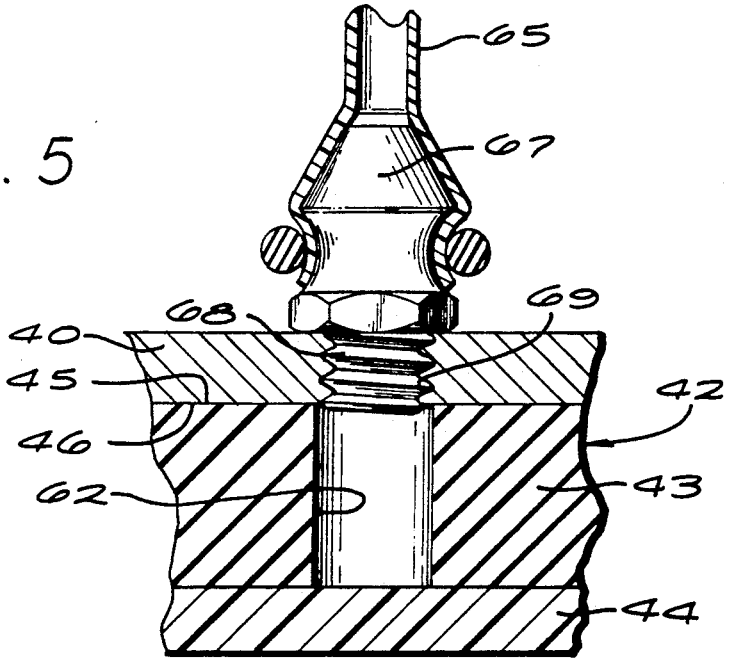
FIG. 5 is an enlarged fragmentary vertical section taken on line 5—5 of FIG. 4.

The water is injected into passages 62 in the sanding pad from a flexible hose 65 which is connected to a source 66 of water under pressure. The end of hose 65 may be connected to a tubular metal fitting 67 (FIG. 5), having a lower threaded end 68 connected threadedly into an opening 69 formed in backing plate 40 of the sanding pad. Passages 62 in the foam layer 43 may be arranged in any convenient pattern, preferably that illustrated in FIG. 4. More particularly, the passages as shown in FIG. 4 include two generally parallel elongated main passages **62*a* and 62*b* connected at their right ends as seen in FIG. 4 by a cross passage 62*c* near which the water inlet fitting 67 delivers water under pressure from source 66. A number of branch passages 62*d* extend laterally from the main passages 62*a* and 62*b* to the locations of the different openings 63 in bottom layer 44 of the cushion, to deliver the water to those different openings for flow downwardly therethrough to the work. The various passages 62 are closed at their upper side by plate 40 and at their underside by bottom layer 43 of the cushion, except at the locations at which water enters the passages from conduit 65 and discharges from the passages through bottom openings 63**.

The flexible water delivery tube 65 is connected to the rear block 26 of body 11 of the tool by a device 70 which functions both to locate the tube relative to the body and act as a valving mechanism for adjustably restricting the flow of water through tube 65. This valving device 70 may be received adjacent a flat side surface 71 of block 26, and be secured thereto by a threaded stud 72 connected into the block and projecting outwardly therefrom. Device 70 includes a clamping element 73 which may be stamped from sheet metal to the configuration illustrated, and which contains an opening 74 through which stud 72 extends. A nut 75 is threadedly connected onto the end of stud 72, and is manually tightenable against portion 76 of the clamping element 73. A portion 77 of element 73 extends about the outer side of tube 65, containing a recess 78 within which the tube is received in a manner retaining the tube against removal from its illustrated position of retention adjacent surface 71. As will be understood, when nut 75 is tightened against portion 76 of element 73, the resultant movement of portion 77 of element 73 toward surface 71 progressively constricts tube 65 to reduce the rate of water flow therethrough. Such constriction can be continued to a point of complete shutoff of the water if desired. The tube 65 is protected against damage upon such constriction by provision of a cushioning sleeve 79 about the portion 77 of element 73, with that sleeve and tube 65 preferably both being formed of a relatively soft resinous plastic material capable of repeated deformation without damage to either of the parts.

Suitable means may be provided for detachably connecting water tube 65 to the water source 66. For example, the source 66 may deliver water to a conventional externally threaded water supply outlet 80, to which there may be connectable an internally threaded fitting 81 typically having a manually actuable shut-off valve 82 attached thereto. The flexible tube 65 leads from valve 82 to the tool. Preferably, a quick disconnect fitting 83 is connected into tube 65, to allow the tool to be completely detached from the water source at any time, and then be reattached easily and quickly when desired.

In utilizing the tool shown in the drawings, an operator holds the tool by its handle body 11, pressing on air valve lever 28 to commence operation of motor 13 and drive pad 18 and the carried sandpaper sheet 19 orbitally relative to work surface 12 to abrade that surface. If it is desired to deliver water to the work surface, the operator opens shutoff valve 82 and opens the regulating valve 70 to deliver water to the work at any desired rate. The water flows through the passages 62 within the interior of pad 18, and is delivered downwardly through openings 63 and 64 at the underside of the pad and in sandpaper sheet 19, to maintain the work surface clean and lubricated by the water flow. It is noted, however, that the water is effectively retained against entry into the interior of boot 34 to protect the orbital drive parts from the water. The bottom wall of the boot is sealed against entry of water at the location of screw 50 by tight clamping of the bottom wall of the boot between plate 40 and the horizontal undersurface of part 16, entirely about the screw, when the screw is tightened.

It will of course be understood that the invention is applicable to any conventional type of abrading tool as well as the typically illustrated orbital type sander. For example, instead of the orbital drive illustrated in FIGS. 1 and 2, the drive connection between motor 13 and pad 18 may be a straight line type of drive, acting to move pad 18 reciprocally in a straight line during the sanding operation, or may have other types of motion, with water in each case being delivered to the work surface through passages formed within the interior of the sanding pad.

While certain specific embodiments of the present invention have been disclosed as typical, the invention is of course not limited to these particular forms, but rather is applicable broadly to all such variations as fall within the scope of the appended claims.

I claim:

1. A portable abrading tool comprising:

a tool body to be held and manipulated by a user;

a head mounted to said body for movement relative thereto;

a motor carried by said body and operable to move said head relative to the body to abrade a work surface;

said head including a deformable cushion having an essentially flat undersurface against which a sheet of abrading material is held and through which force is applied to said sheet for pressing it against a work surface;

said head including a backing plate more rigid than said deformable cushion and which extends across an upper side thereof and contains a first opening and a second opening;

an orbital drive mechanism powered by said motor and projecting downwardly toward said head, and including a first element driven rotatively by the motor about a first axis and a second element connected eccentrically to said first element for relative rotation about a second axis offset from the first axis to produce orbital movement of the second element;

a boot having a flexible essentially tubular side wall extending downwardly between said body and said head and disposed about said orbital drive mechanism;

said boot having a bottom wall extending generally horizontally at a location vertically between said plate and said second element of the orbital drive mechanism;

a fastener extending upwardly through said first opening in said rigid backing plate and through an opening in said bottom wall of the boot and connected threadedly to said second element of the orbital drive mechanism to attach said head to said second element and said bottom wall of the boot for orbital movement of the head and said bottom wall of the boot with the second element;

said deformable cushion of the head containing a pattern of water passages leading through the interior of said cushion at locations offset from and at different sides of said fastener and leading to a plurality of spaced bottom openings in said undersurface of the cushion at different sides of the fastener communicating with spaced openings in said abrasive sheet; and means for delivering water under pressure into said passages in the cushion for flow therethrough to said plurality of spaced openings in said undersurface of the cushion to discharge therefrom downwardly through said spaced openings in the abrasive sheet to said work surface;

said means including a water inlet line connected to said backing plate at the exterior of said boot and delivering water under pressure through said second opening in the plate into said passages for flow through said passages to the work surface, with said boot forming a seal preventing access of the water to said drive mechanism.

2. A portable abrading tool as recited in claim 1, in which said spaced bottom openings in said undersurface of the deformable cushion include two series of such openings near two opposite sides respectively of said head and at opposite sides of said fastener, with each of said series including at least three openings.

3. A portable abrading tool as recited in claim 1, in which said water passages in said deformable cushion include two principal passages extending generally parallel to one another at opposite sides of said fastener and near two opposite side edges respectively of the head, with said principal passages leading water to two series respectively of said spaced bottom openings in the undersurface of the cushion at opposite sides of the fastener, and with each of said series of openings including at least three of the openings.

4. A portable abrading tool as recited in claim 1, including a sheet of abrading material as an element of the claim retained against said undersurface of the deformable cushion and containing spaced openings through which water discharges from said openings in the cushion.

5. A portable abrading tool as recited in claim 1, including means for regulating the rate of delivery of water to said passages in the cushion.

6. A portable abrading tool as recited in claim 1, including valve means carried by said body and relative to which said head is orbitally movable to abrade said work surface, said valve means being operable to variably restrict the delivery of water to said passages in the cushion.

7. A portable abrading tool as recited in claim 1, in which said water inlet line includes a flexible conduit for delivering water from a source thereof to said passages in the deformable cushion, there being a constricting device carried by said body and operable to variably restrict said flexible conduit to regulate the rate of delivery of water to the head; said conduit having a portion extending between said body and said head and which is free for flexure as the head moves orbitally relative to the body while maintaining the delivery of water through the conduit to the head.

8. A portable abrading tool as recited in claim 1, in which said means include a source of water connected to said inlet line for delivering water under pressure through the inlet line and said second opening in the backing plate and said passages to a work part.

9. A portable abrading tool comprising:

a tool body to be held and manipulated by a user;

a head mounted to said body for movement relative thereto;

a motor carried by said body and operable to move said head relative to the body to abrade a work surface;

said head including a deformable cushion having an essentially flat undersurface against which a sheet of abrading material is held and through which force is applied to said sheet for pressing it against a work surface;

an orbital drive mechanism powered by said motor and projecting downwardly toward said head, and including a first element driven rotatively by the motor about a first axis and a second element connected eccentrically to said first element for relative rotation about a second axis offset from the first axis to produce orbital movement of the second element;

a boot having a flexible essentially tubular side wall extending downwardly between said body and said head and disposed about said orbital drive mechanism;

said boot having a bottom wall extending generally horizontally at a location vertically between said head and said second element of the orbital drive mechanism;

a fastener removably connecting said head to said second element and said bottom wall of said boot for orbital movement of the head and said bottom wall of the boot with the second element;

said deformable cushion of the head containing a pattern of water passages leading through the interior of said cushion to a plurality of spaced bottom openings in said undersurface of the cushion; and means for delivering water under pressure at the exterior of said boot into said passages in the cushion for flow therethrough to said plurality of spaced openings in said undersurface of the cushion to discharge therefrom downwardly through said spaced openings in the abrasive sheet to said work surface, with said boot forming a seal preventing access of the water to said drive mechanism.

* * * * *